US006325669B1

(12) United States Patent
Safai

(10) Patent No.: US 6,325,669 B1
(45) Date of Patent: Dec. 4, 2001

(54) ELECTRICAL CONNECTOR SEALING SYSTEM

(75) Inventor: Sohrab Safai, Laguna Niguel, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/611,904

(22) Filed: Jul. 6, 2000

(51) Int. Cl.[7] ..... H01R 13/40
(52) U.S. Cl. ..... 439/587; 439/274
(58) Field of Search ..... 439/587, 588, 439/589, 271, 274, 275, 586, 157, 272

(56) References Cited

U.S. PATENT DOCUMENTS

| | | | | |
|---|---|---|---|---|
| 3,710,003 | | 1/1973 | Channell | 174/37 |
| 3,787,796 | | 1/1974 | Barr | 339/60 |
| 3,848,074 | | 11/1974 | Channell | 174/38 |
| 3,880,487 | | 4/1975 | Goodman et al. | 339/60 |
| 4,173,349 | | 11/1979 | Neale, III | 277/6 |
| 4,241,967 | | 12/1980 | Collins | 339/59 |
| 4,681,691 | | 7/1987 | Schriver, Jr. | 252/12 |
| 4,713,021 | | 12/1987 | Kobler | 439/589 |
| 4,921,437 | | 5/1990 | Cooper et al. | 439/275 |
| 4,981,446 | * | 1/1991 | Lazaro, Jr. et al. | 439/589 |
| 4,993,964 | * | 2/1991 | Trummer | 439/272 |
| 4,998,896 | | 3/1991 | Lundergan | 439/595 |
| 5,035,638 | | 7/1991 | Kourimsky | 439/275 |
| 5,299,949 | | 4/1994 | Fortin | 439/275 |
| 5,607,318 | | 3/1997 | Wakata et al. | 439/274 |
| 5,709,560 | * | 1/1998 | Hio | 439/157 |
| 5,931,699 | * | 8/1999 | Saito | 439/587 |
| 6,155,850 | * | 12/2000 | Martin et al. | 439/157 |
| 6,196,872 | * | 3/2001 | Murakami et al. | 439/587 |

* cited by examiner

*Primary Examiner*—Hien Vu
(74) *Attorney, Agent, or Firm*—Roger C. Turner

(57) ABSTRACT

A connector has a rigid insulator (32) with insulator passages (70), an elastomeric seal member (34) with seal passages (72) aligned with the insulator passages, and contacts (12, 14) with front ends lying in the rigid insulator passages and rear ends connected to wires (20, 22) that extend through and rearward of the seal member, which enables environmental sealing to the wires while permitting large contacts (12) to be installed through large seal member passages without damage to the seal member. A modular elastomeric insert (140) lies in each large seal passage, with its outside in interference fit with the seal passage (72) and its inside in interference fit with the wire (20), so the large diameter contact can be passed through the seal passage when the modular insert is not in place.

9 Claims, 3 Drawing Sheets

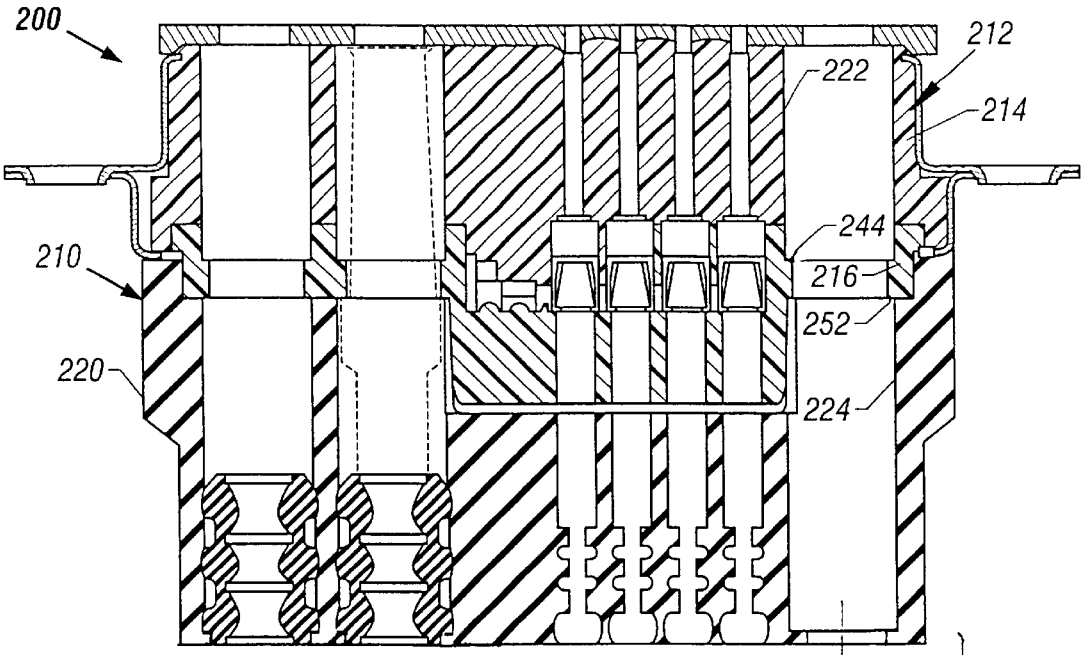
FIG. 5
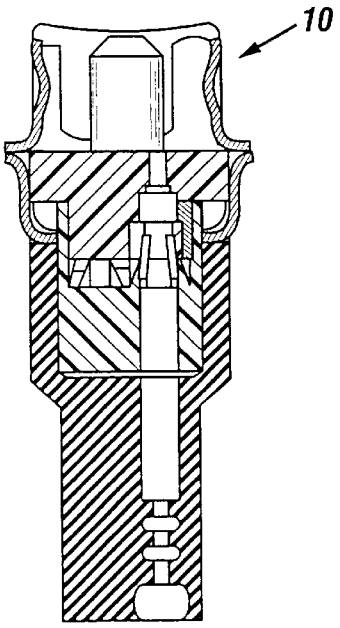
FIG. 4
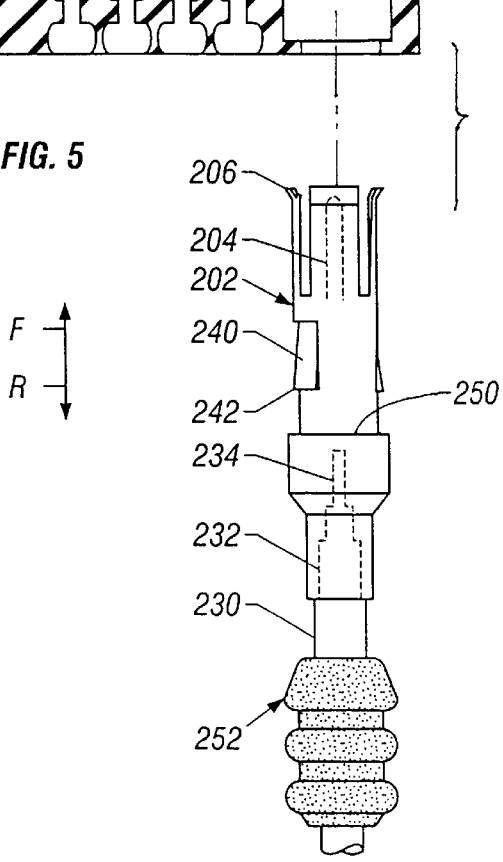

ELECTRICAL CONNECTOR SEALING SYSTEM

BACKGROUND OF THE INVENTION

One type of connector includes a rigid insulator of rigid molded engineering plastic, which is a material having a Young's modulus of elasticity of at least 100,000 psi, and a seal member of elastomeric material, which is a material having a Young's modulus of elasticity of no more than 50,000 psi. The rigid insulator and elastomeric seal member have aligned passages which receive contacts that have wires extending rearwardly therefrom. The wires extend through and behind the seal member. The rigid insulator forms forwardly and rearwardly facing shoulders that engage corresponding shoulders on the contact to prevent movement of the contact, while the seal member seals to the wire to prevent water or other fluids from passing therethrough to the exposed parts of the contact and wire.

Most contacts carry signals and have maximum diameters that are not much greater than the diameter of the wire extending therefrom. However, some contacts have a large diameter, such as contacts for carrying power and coaxial contacts that have center and outer contact parts. It is often possible to connect wires of moderately small diameter to such large diameter contacts. However, there is a problem in assuring a seal between the walls of the seal passage and the outside diameter of such moderately small diameter wires that are connected to large diameter contacts. When the difference in diameter between the maximum diameter of the contact and the diameter of the wire is only moderate, then the contact can be pushed into place and removed through the seal passage without damage. However, a large difference in diameters results in damage to the seal passage as the large diameter contact is pushed through the seal passage. It is possible to use a larger diameter wire for the large diameter contact, but this has the disadvantage that the larger diameter wire takes up more space in a cable, as well as increasing the cost. A connector that enabled a large diameter contact to be forced forwardly or rearwardly through a seal passage without damage thereto, while the seal passage provided a reliable interference fit with the wire extending from the contact, in a simple and easily installed assembly, would be of value.

SUMMARY OF THE INVENTION

In accordance with one embodiment of the present invention, an improved connector is provided, of the type that has a rigid insulator and an elastomeric seal member behind the rigid insulator, with a contact being securely held in the rigid insulator and a wire that extends from the contact being sealed to the seal member. The improved connector enables a contact to pass through the seal passage without damage to the seal passage, despite a large difference in diameter between the maximum diameter of the contact and the outside diameter of the wire extending therefrom. The connector includes a modular elastomeric insert having a tubular inside surface lying in interference fit with the wire to seal to it and having an outside surface lying in an interference fit with the corresponding seal passage. The modular insert is threaded on the wire so the contact can pass through the insulator passage without the insert in place, the insert then being forced into the insulator passage. The connector can include additional contacts with wires extending therefrom, where there is not such a large difference in diameters between the largest diameter of the contact and the outside of the wire, so those smaller contacts can be forced through sealing walls of the sealing passage without damage to them and with the sealing walls being integral with the rest of the seal member.

The novel features of the invention are set forth with particularity in the appended claims. The invention will be best understood from the following description when read in conjunction with the accompanying drawings.

BRIEF DESCRIPTION OF THE DRAWINGS

FIG. 4 is a sectional view of the connector of FIG. 3.

FIG. 5 is an exploded sectional view of a connector of another embodiment of the invention, where the large contact is a coaxial contact.

DESCRIPTION OF THE PREFERRED EMBODIMENTS

Figure 1:
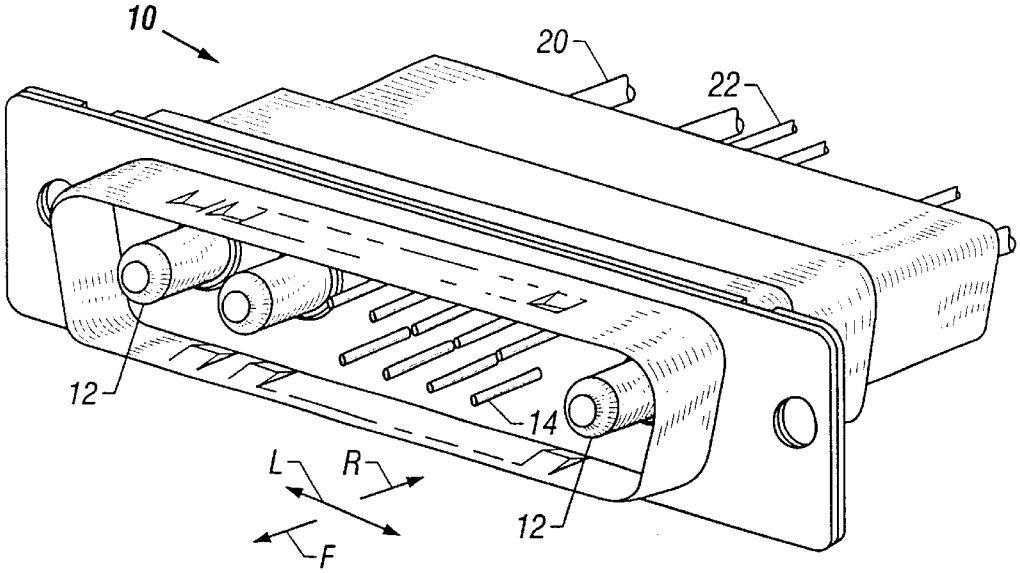
FIG. 1 is a front isometric view of a connector constructed in accordance with a first embodiment of the invention.
Figure 2:
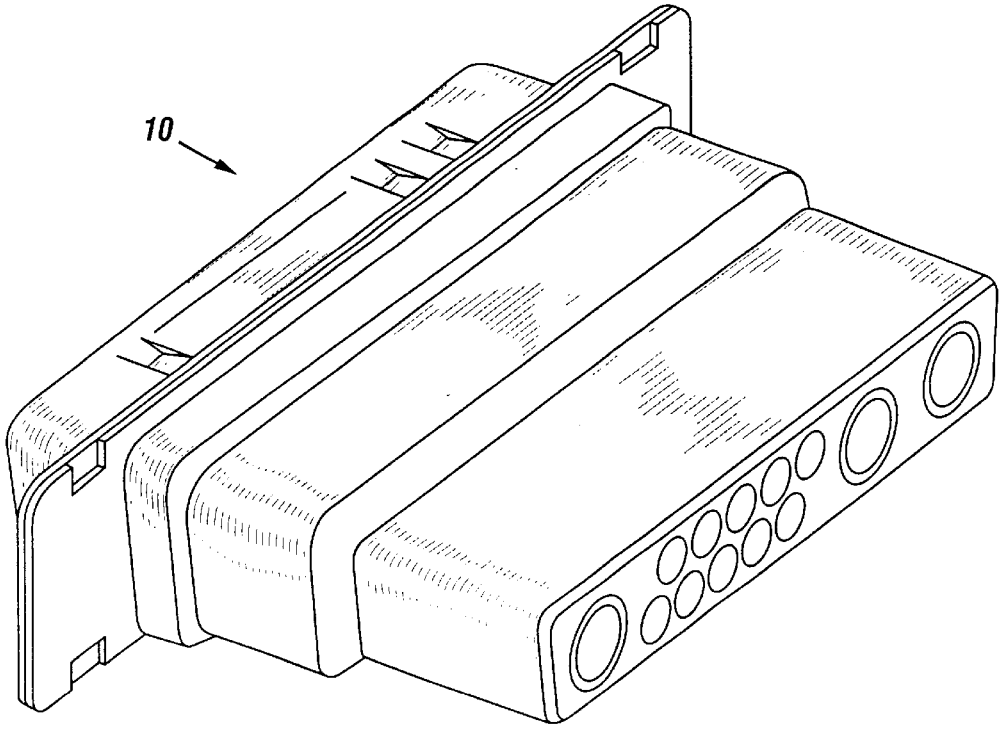
FIG. 2 is a rear isometric view of the connector of FIG. 1.

FIGS. 1 and 2 illustrate a connector 10 which has large contacts 12 and small contacts 14. The particular large contact assemblies or contacts 12 are power contacts that carry large currents and therefore require a larger area and larger cross section to minimize heating, while the small contacts 14 are signal contacts that carry signals of low current. The contacts mate to contacts of another connector by moving in a forward direction F. Wires 20 have front ends terminated to the large contacts and extend rearwardly R from the connector, while smaller wires 22 are connected to the smaller contacts and extend rearwardly from the connector.

Figure 3:
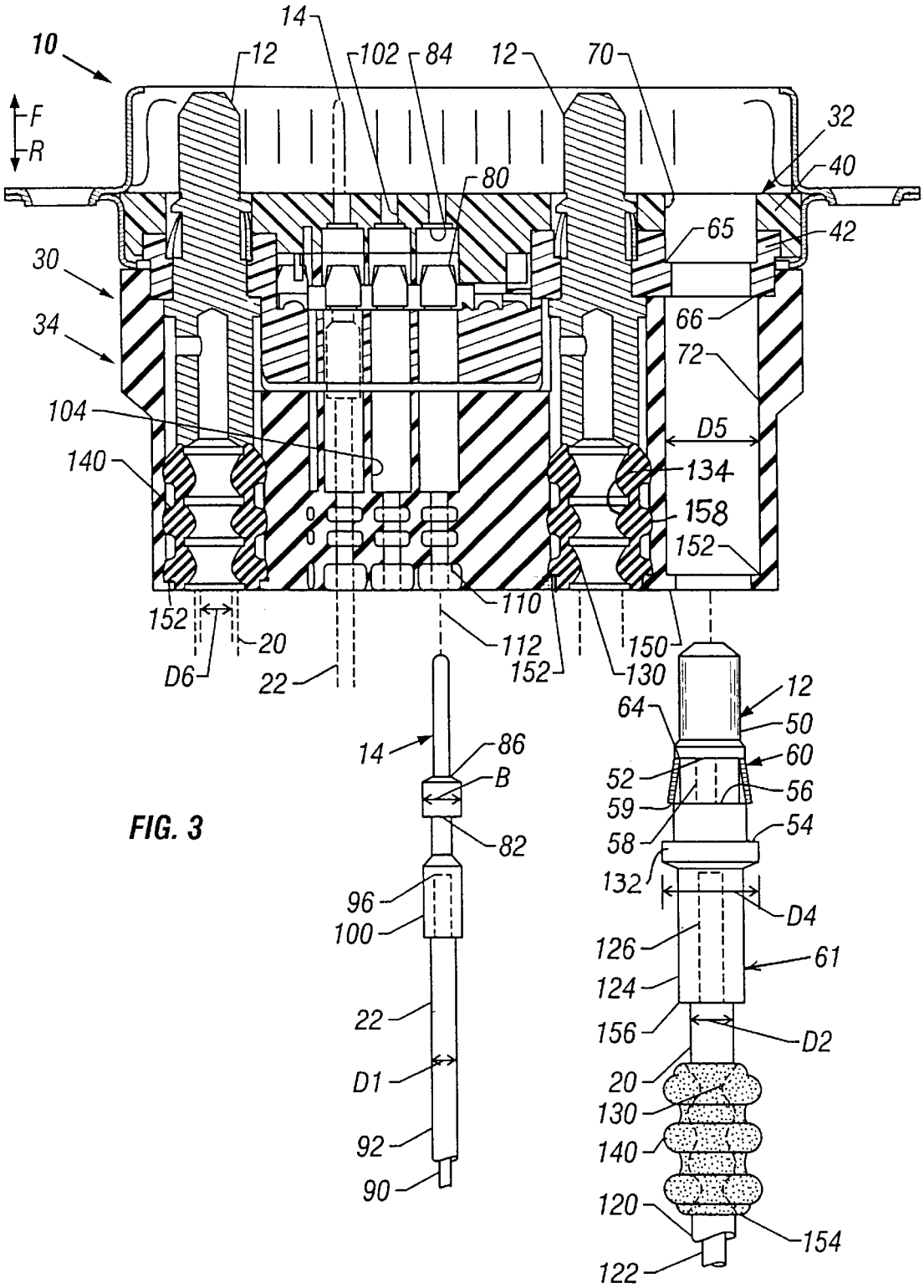
FIG. 3 is a sectional and exploded view of the connector of FIG. 1, showing one large contact and one small contact lying outside the connector body.

As shown in FIG. 3, the connector includes a connector body 30 with a rigid insulator 32 that fixes the positions of the contacts 12, 14 and an elastomeric seal member 34 that seals to the wires 20, 22 to keep moisture away from the location where the wires terminate to the contacts. The rigid insulator includes front and rear parts 40, 42 that are each molded of a rigid engineering polymer, which is a polymer having a Young's modulus of elasticity of at least 100,000 psi. The seal member 34 is molded of elastomeric material, which is material having a Young's modulus of elasticity of less than 50,000 psi. The front end of the seal member is fixed to the rigid insulator as by adhesive or thermal bonding.

Each large contact assembly or contact 12 includes a sheet metal lock ring 60 on a solid machined part 61. The contact includes a contact front portion 50 for engaging a mating contact, a rearwardly-facing shoulder 52 and two forwardly-facing shoulders 54, 56. The sheet metal ring lock 60 is formed by a piece of sheet metal rolled into a cylinder with a gap indicated at 58. The lock ring has an inwardly angled front end forming a forwardly-facing shoulder 64 that abuts the contact shoulder 52, and has a lock ring rear shoulder 59 that abuts the contact shoulder 56. This keeps the lock ring in place on the rest (part 61) of the contact. When a large contact assembly is pushed forwardly into place, the shoulder 59 on the ring lock snaps behind a forwardly-facing shoulder 65 on the insulator part 42 to prevent contact removal. At the same time, the forwardly-facing shoulder 54 on the contact substantially abuts a rearwardly-facing shoulder 66 formed at a rear surface of the rigid insulator, to prevent any further forward movement of the large contact.

The rigid insulator 32 has contact-holding passages 70 that receive the large contacts, while the elastomeric seal member 34 has corresponding seal passages 72 that receive the large contacts and through which the large wires 20 extend.

The small contacts 14 are held in a manner similar to that for the large contacts, with the rigid insulator 32 having tines 80 with free front ends forming forwardly-facing shoulders that engage rearwardly-facing shoulders 82 on small contacts. The rigid insulator also forms a rearwardly-facing shoulder 84 that engages a forwardly-facing shoulder 86 of the small contact. Thus, the small contacts, like the large ones, can be installed by sliding them forwardly into place, until resilient shoulders snap behind the rearwardly-facing shoulders of the contacts.

The small wires 22 each includes a copper core 90 and an insulator 92 surrounding the core. The front end of the insulator is stripped, the front end 96 of the core is inserted into a sleeve 100 at the rear end of the small contact, and the wire core is terminated to the contact. Termination can be accomplished by crimping the sleeve 100. Another type of sleeve enables soldering of the core front end 96 to the contact sleeve. The rigid insulator forms small passages 102 that receive the small contacts, while the elastomeric seal member 34 forms small seal passages 104 through which the contact and small wires 22 extend.

The seal member forms internal ridges 110 that project radially inwardly towards the axis 112 of the seal passage, to seal to the outside of the wire 22. The internal diameter of the internal ridges results in an interference fit with the wire 22 to provide a moisture-tight seal. The internal diameter is less than the maximum diameter B of the small contact. As a result, insertion of the contact requires it to be pushed forcefully forward through the internal ridges 110, which are deflected out of the way as the large diameter portions of the contact pass through it. The difference in diameter between the maximum diameter B of the small contact and the diameter D1 of the wire (which is constant) is not great. As a result, the contact can be gently pushed through the internal ridges 110 to the installed position of the contact, without permanent damage to the internal ridges that would result in the absence of a moisture seal against the small wire 22. It is noted that the diameter of the small passage 104 in the elastomeric seal member is preferably about equal to the maximum diameter B of the contact, and in almost all cases the diameter of the passage 104 is at least 95% of the contact maximum diameter B to enable insertion of the contact.

The large wire 20 includes an insulator 120 and a copper core 122. The core is terminated to a sleeve 124 of the large contact in the same way as for the small contact, as by crimping the sleeve around the front end 126 of the core.

The large wire 20 is sealed in place by internal ridges 130 in the seal passage that lie in interference fit with the large wire. It would be possible to form the large ridges 130 integrally with the rest of the seal member 34, as is done for the small ridges 110 that seal against the small contacts and wires. However, there would be disadvantages in making the large internal ridges 130 integral with the seal member 34. This is because the largest diameter D4 of a part 132 of the large contact is much larger than the diameter D2 of the large wire. As a result, if the large contact part is pushed through internal ridges 130 of a diameter to make an interference fit with the large wire, the large contact part 54 would cause permanent damage to the ridges, resulting in the considerable possibility that there will not be a watertight seal around the large wire.

To avoid damage to the large internal ridges 130, applicant forms the large internal ridges 130 at the tubular inside surfaces 134 of elastomeric module inserts 140 that are molded separately from the seal member 34. A modular insert 140 is slipped onto a large wire 20 prior to termination of the wire core front end 126 to the contact. After termination of the wire to the contact, the contact is pushed forwardly through passages 72, 70 in the seal member and in the rigid insulator, until the large contact is in or very close to being in its fully installed position. Then, the modular insert 140 is pushed forwardly into the seal passage. It should be noted that the seal member has an internal flange 150 with a forwardly-facing flange surface 152. The modular insert 140 is slightly compressed as it is pushed past the flange, until a rearwardly-facing insert surface 154 at the rear of the insert abuts the flange surface 152. At that time, the insert is slightly compressed against a rear end 156 of the contact and the outer surface 158 of the insert lies in an interference fit with the inside of the seal body. The insert is preferably not bonded in place, to permit replacement of a contact. The inside diameter D5 of the seal passage 72 is preferably about the same as the maximum outside diameter D4 of the contact, although it is possible to use a seal passage 72 that is as little as 95% of the maximum contact diameter.

In a connector that applicant has designed, the small contacts 14 have a largest diameter B of 85 mils (one mil equals one thousandth inch) while the small wires have a diameter D1 of 48 mils, for a ratio of 85/48=1.8. Applicant finds that sealing of the small internal ridges 110 to the wire can be maintained after the contact is pushed through the ridges, with this ratio of 1.8 of the contact maximum diameter to the wire outside diameter. The large contact had a largest diameter D4 of 225 mils, while the wire had a diameter D2 of 100 mils, for a ratio of 225/100 or 2.25:1. Applicant found that internal ridges that could seal to the large wire, would be damaged by passage of the large contact so sealing could not be assured. It appears that when the ratio of contact maximum diameter to wire diameter is more than about 2:1, that applicant's separate modular insert is desirable, while when the ratio is less than 2:1 that the integral internal ridges, which are integral with the rest of the seal member, can be used while providing reliable sealing. Also, when the difference in diameter of 0.225–0.100=0.125 inch is greater than about 0.1 inch, that a separate modular insert is desirable. For the small contact assembly the difference is only 0.85–0.048=0.037 inch.

In the connector that applicant designed, each large seal member passage diameter D5 was 0.227 inch which was more than 250% the diameter D6 of each insert internal ridge. Actually, the inside diameter D6 is 0.07 inch.

FIG. 5 shows a connector 200 of another embodiment of the invention, where the large contacts 202 are each a coaxial contact with a pin-like center contact part 204 and a socket type outer coaxial contact part 206. The connector includes a body 210 with a rigid insulator 212 of a molded rigid engineering polymer in each of its parts 214, 216, and an elastomeric seal member 220. The rigid insulator 212 has passages 222 aligned with corresponding passages 224 in the seal member. A coaxial wire or cable 230 has an outer conductor 232 terminated to the outer contact part, and has a center conductor 234 terminated to the inner contact part 204. The outer contact part 206 is of sheet metal, in which slots have been formed to leave tines 240 with rearwardly-facing shoulders 242 that engage shoulders 244 on the rigid insulator. A forwardly-facing shoulder 250 on the contact engages a shoulder 252 on the rigid insulator. An elastomeric modular insert 252 seals the wire 230 to the inside of the seal member passage 224. It is noted that a contact with a socket part 206 is difficult to force through internal seal ridges, and the modular insert 252 is especially useful in this case.

Thus, the invention provides a connector with a rigid Insulator and an elastomeric seal member having aligned passages that hold a contact with a wire extending rearwardly from the contact and which seals to the wire, which avoids damage to the seal despite a large difference of more than 180% between the largest diameter of the contact and the diameter of the wire. Where such a large difference exists, damage to the seal is avoided by providing a separate elastic modular insert that is inserted into the seal passage after the contact has been installed. The seal insert can lie in a passage of a connector seal member, which has one or more small passages where the largest diameter of the contact is not that much greater than the outside diameter of the corresponding small wire, and where the seal ridges that press against the outside of the wire are integrally formed with the rest of the seal member instead of being formed as separate inserts. The seal member preferably has an internal flange at the rear of each passage that is to hold a modular insert, and the modular insert is pushed past the flange and thereafter held in place by the flange.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising;

a connector body that includes a rigid insulator forming a plurality of contact-holding insulator passages, said connector body forming a rearwardly-facing shoulder in each insulator passage to limit forward insertion of a contact into the insulator passage, and forming a forwardly-facing shoulder along each insulator passage for retaining the forwardly inserted contact against rearward removal;

a plurality of contacts each lying in one of said insulator passages and having forwardly and rearwardly-facing shoulder parts lying substantially against said rearwardly-facing and forwardly-facing shoulders of said connector body, including first and second contacts;

a plurality of wires, each having a front end joined to one of said contacts and extending rearwardly therefrom, including a first wire joined to said first contact and a second wire joined to said second contact;

said connector body includes an elastomeric seal member fixed to said rigid insulator, said seal member having a plurality of seal passages including first and second seal passages, that are each aligned with one of said insulator passages, with said wires passing through said seal passages;

said seal member having seal walls that press firmly against at least said first wire;

a modular elastomeric insert having a tubular inside surface lying in an interference fit with said second wire and having an outside surface lying within and in sealing interference fit with said second seal passage;

said second contact has a maximum diameter that is more than 180% of the outside diameter of said second wire.

2. The connector described in claim 1 wherein:

said first and second wires each has an outside diameter;

said second contact has a front portion that lies in and immediately behind said rigid insulator, said front portion having a maximum second contact diameter that is more than twice the diameter of the outside of said second wire, while the maximum diameter of said first contact is less than twice the diameter of the outside of said first wire.

3. The connector described in claim 1 wherein:

said second contact maximum diameter is at least 2 mm greater than the outside diameter of said second wire.

4. The connector described in claim 1 wherein:

said second seal passage is cylindrical except at a rear end thereof, and said second seal passage has a radially inwardly-extending flange at said rear end which is of smaller inside diameter than said insert outside diameter but which allows the insert to be pushed through the flange.

5. The connector described in claim 4 wherein:

said insert has a rear end portion with a rearwardly-facing insert surface, and said flange has a forwardly-facing flange surface engaged with said rearwardly-facing insert surface.

6. A connector comprising:

a rigid insulator forming a plurality of insulator passages;

a plurality of contacts each lying in one of said insulator passages, said plurality of contact including a first contact having a diameter and a second contact having a larger diameter than the diameter of said first contact;

a plurality of wires that each has a front end joined to one of said contacts and which extends rearward therefrom and which has a wire outside diameter;

an elastomeric seal member fixed to said rigid insulator and having a plurality of seal passages that are each aligned with one of said insulator passages, with said wires each passing through one of said seal passages;

a second of said wires lies in a second of said seal passages and is connected to said second contact which lies in a second of said insulator passages;

said second contact has a maximum diameter which is more than 180% of said second wire outside diameter;

said second seal passage has a diameter along most of its length, which is at least 95% of said second contact maximum diameter; and including a modular elastomeric insert having a tubular inside surface lying in interference fit with said second wire and an outside surface lying in sealing interference fit with said second seal passage.

7. The connector described in claim 6 wherein:

a first of said wires lies in a first of said seal passages and is connected to a first of said insulator passages;

said first contact has a maximum diameter which is greater than said first wire diameter, but with the ratio of said first contact maximum diameter to said first wire diameter being less than the ratio of said second contact maximum diameter to said second wire diameter;

said first seal passage has seal passage walls lying in interference fit with said first wire, with said seal passage walls being integral with said elastomeric seal member.

8. A connector comprising:

a rigid insulator forming a plurality of insulator passages for holding contacts that are connected to front ends of wires;

an elastomeric seal member fixed to said rigid insulator and having a plurality of seal passages that are each aligned with one of said insulator passages for passing said contacts, said plurality of seal passages including a second seal passage that has a radially inwardly projecting flange at it's rear end;

said second of said seal passages has a predetermined inside diameter along most of its length, for passing a contact to a second of said insulator passages and for surrounding a second wire; and including a modular elastomeric insert having a tubular inside surface with a plurality of internal ridges having a minimum diameter to provide an interference fit with said second wire and an outside surface of a diameter to lie in interference fit with said second seal passage;

said inside diameter of said second seal passage is at least 250% of the diameter of said insert inside surface minimum diameter.

9. The connector described in claim 8 wherein:

said inside diameter of said second seal passage is at least 2 mm larger than the diameter of said insert inside surface.

* * * * *